US010337673B2

(12) United States Patent
Hobbs

(10) Patent No.: US 10,337,673 B2
(45) Date of Patent: Jul. 2, 2019

(54) PRESSURE VESSEL LID QUICK CLOSURE SYSTEM

(71) Applicant: Gordon Basil Hobbs, Cambridge (CA)

(72) Inventor: Gordon Basil Hobbs, Cambridge (CA)

( * ) Notice: Subject to any disclaimer, the term of this patent is extended or adjusted under 35 U.S.C. 154(b) by 610 days.

(21) Appl. No.: 14/701,583

(22) Filed: May 1, 2015

(65) Prior Publication Data

US 2016/0319995 A1 Nov. 3, 2016

(51) Int. Cl.
*B65D 90/10* (2006.01)
*F17C 13/06* (2006.01)
*B65D 45/34* (2006.01)

(52) U.S. Cl.
CPC ..... *F17C 13/06* (2013.01); *B65D 45/34* (2013.01)

(58) Field of Classification Search
CPC ..... B65D 90/10; B01J 3/03
USPC ..... 220/320, 321, 213, 316
See application file for complete search history.

(56) References Cited

U.S. PATENT DOCUMENTS 2,420,411 A * 5/1947 Blount, Sr. ..... F17C 13/06 16/287

* cited by examiner

*Primary Examiner* — King M Chu
(74) *Attorney, Agent, or Firm* — David J. Schnurr; Miller Thomson LLP

(57) ABSTRACT

This invention is a mechanism enabling rapid manual opening and closing of a pressure vessel lid without using tools. A pressure vessel bears two circular mating rings welded to the adjacent rims of the vessel lid and shell respectively with the latter ring grooved to house an O-ring. These mating rings are externally tapered to match the internal tapers of a pair of semi-circular external clamping elements. The mechanism applies tension at the vessel perimeter to draw the external clamping elements radially inward, engaging male and female tapers with sufficient force to compress the O-ring and maintain static clamping of the pressurized lid and shell. Tension is produced by levered rotation of two diametrically-opposed slotted plates where cylindrical pins mounted on the ends of the external clamping elements ride in the plate slots and cam action applies mechanical advantage causing the pins to converge. The mechanism incorporates very few components which are readily manufactured and multiple safety features prevent unintentional actuation.

12 Claims, 13 Drawing Sheets

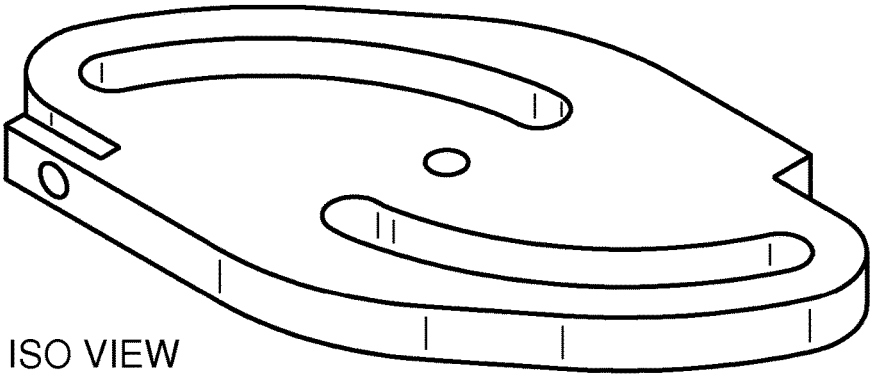
FIG. 18
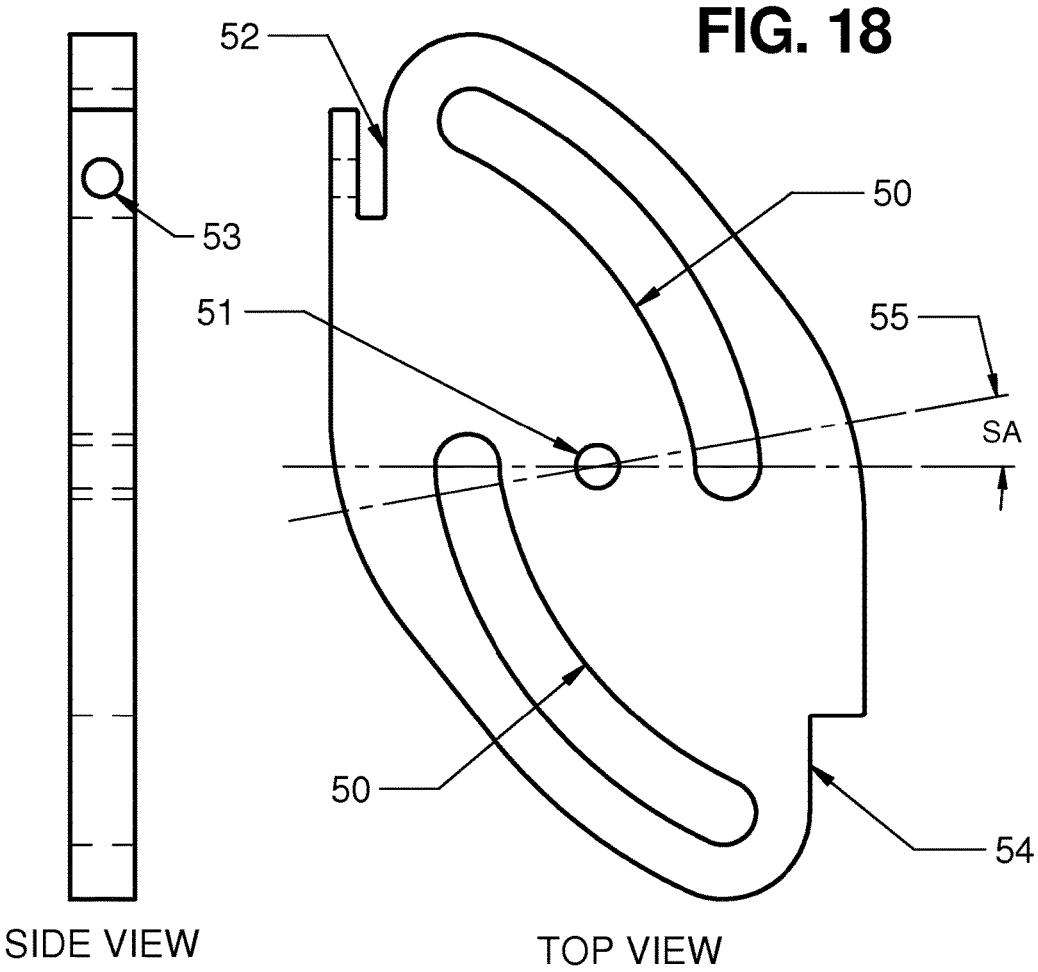

PRESSURE VESSEL LID QUICK CLOSURE SYSTEM

CROSS REFERENCE TO RELATED APPLICATIONS

Not Applicable

BACKGROUND OF THE INVENTION

The present invention is a manually operated lid closure system for industrial vessels which operate under high negative or positive pressure. Typical closure devices for vessels are described in many U.S. Pat. Nos. 3,077,360, 3,144,165, 4,157,146, 4,288,001, 4,347,944, 5,433,334, 6,401,958, 7,341,161, 7,802,694, 8,251,243, and 8,308,011. These designs are based on using screws, levers, toggles, tapered tongues, clamps, or hydraulic cylinders to exert tension on the mechanism that induces a clamping force to seal the lid of the pressure vessel to its shell.

These earlier designs suffer from several drawbacks. They typically involve configurations of complex parts for the closure mechanism. Existing component features require complicated and costly fabrication techniques. Most of the designs are not scalable for vessels of widely varying size. Finally, the operation of existing closure systems is time-consuming, physically taxing, or require special tools to perform.

The present invention is a unique mechanism which enables the application of sufficient mechanical restraint to contain high-pressure fluids with a manually operated cam device. No tools are necessary to quickly open or close any vessel equipped with this device.

SUMMARY OF THE INVENTION

The present invention provides for the rapid manual opening and closing of the lid of an industrial pressure vessel without the need for any tools. A pressure vessel is equipped with two circular mating rings welded to the adjacent rims of the vessel shell and the vessel lid respectively. The vessel shell ring bears a groove within which sits a compressible O-ring. These rings are tapered at an angle to accommodate external clamping elements with matching taper angles. Each clamping element is a semi-circular assembly of enclosing rings or a plurality of enclosing blocks which is drawn radially towards the center of the vessel, forcing the shell and lid rings together along mating inclines until the lid and shell rings are in full contact around the perimeter of the vessel.

The mechanism which applies tension to draw the clamping elements radially inward relies on a pair of cam plates. The cam plates;

i) are arranged parallel to each other.

ii) are located on opposite sides of the vessel.

iii) share a common pivot axis in the plane of the mating faces of the aforementioned lid and vessel rings, said horizontal pivot axis also intersecting the vertical central axis of the vessel shell itself.

iv) rotate in concert in parallel vertical planes by manual force applied to a lever fabricated from round rod which wraps around the vessel body and is connected to both plates.

Pins mounted in the horizontal plane in clevises at the ends of each of two semi-circular clamping elements maintain contact with cam surfaces in curved slots in the cam plates. While the cam plates pivot about their centers in the vertical plane, the cam surfaces in the plates draw the aforementioned pins together with increasing mechanical advantage as the pins approach their minimum separation distance. The clamping elements are constrained to move radially in a horizontal plane by guide plates within which the clevises slide. Integral with the semi-circular external clamping elements, the pins cause the clamping elements to engage in a balanced fashion with the lid and shell rings and apply a closing force through the action of sliding tapers.

The cam elements may be variably configured to apply increasing force gradually to overcome compression resistance of the O-ring in its groove in the shell ring until the lid and shell rings are in full contact. Once in a fully closed position, the clamping mechanism is also capable of withstanding the forces of vessel pressure which tend to separate the lid from the vessel shell.

When it is necessary to open the vessel lid, the rotation of the cam plates is reversed, the pins mounted in the clamping element clevises separate, and the clamping elements slide away from the mating rings on the lid and shell until sufficient clearance is obtained to allow the lid to be lifted without interference. The procedures for both closing and opening the vessel lid take only moments using average human hand effort.

Three different safety features ensure that the cam-operated closure mechanism cannot be activated to release vessel pressure before they are intentionally set in the released position:

i) One safety feature is a design characteristic of the cam surfaces in the cam plate. As the cam plate is rotated to draw the clamping element pins together, the last few degrees of rotation occur with the pins sliding on cam surfaces that are radially concentric with the pivot axis of the cam plate. This ensures that there is no resolved force of the clamping elements under tension that would tend to cause the pins to separate even if the rotation of the cam plate is unconstrained.

ii) A second safety feature is a lever and associated linkage connected to a pressure relief valve typically mounted at the apex of the lid of the pressure vessel. When the vessel is under pressure, the aforementioned lever rests in a slot in the cam plate body, preventing rotation of the cam plate. The lever is positively retained in the cam plate slot with a spring-loaded retractable pin. Until the aforementioned pin is retracted, the lever may not be disengaged. Disengagement of the lever drives the associated linkage to cause the pressure relief valve to open, thereby ensuring release of vessel pressure prior to operation of the cam mechanism for opening the vessel lid.

iii) A third safety feature is a retaining bracket mounted on the side of the vessel shell. When the vessel lid is in the closed position and the clamping elements are engaged with the lid and shell rings, the aforementioned lever which enables hand-operated rotation of the cam plates rests in a slot in the retaining bracket. The lever is retained therein by a pin which must be removed manually before the closure mechanism can be actuated.

The invention provides for a very rapid opening and closing of a pressure vessel for access to its internal features without the need for mechanical tools or auxiliary systems such as hydraulic or pneumatic machinery.

BRIEF DESCRIPTION OF THE DRAWINGS

FIG. 18 is a 3-view depiction of a typical cam plate integral to the quick-closure mechanism.

DETAILED DESCRIPTION OF THE INVENTION

Figure 1:
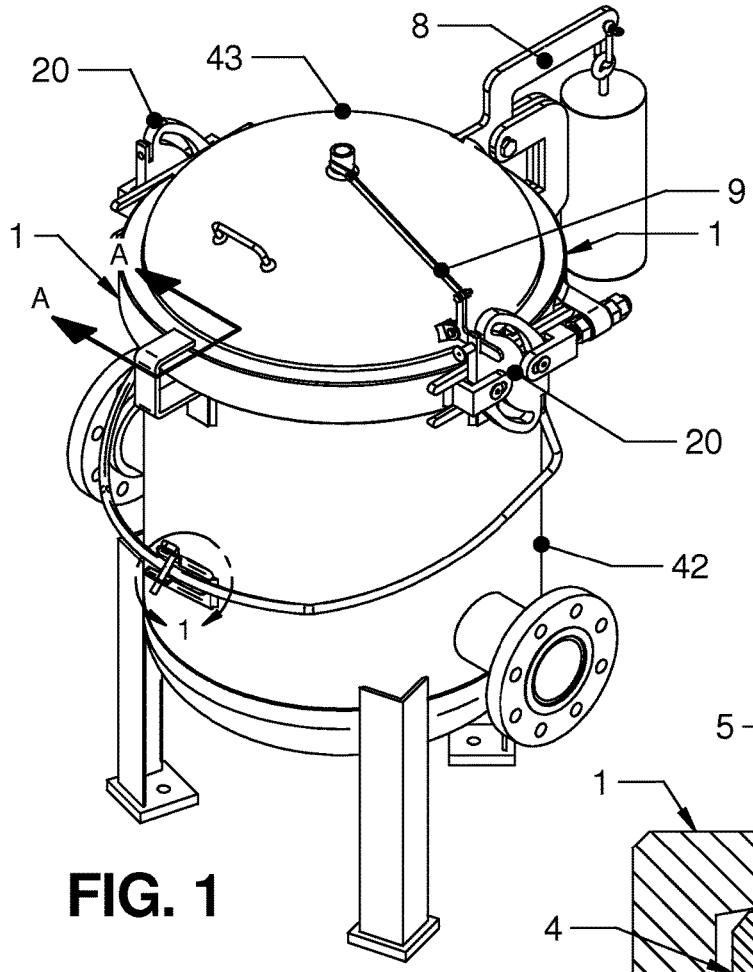
FIG. 1 is a perspective view of a typical closed-lid vessel equipped with the cam-actuated closure mechanism and a detail view of one of the safety lock features.

The following is a listing of reference numbers corresponding to a particular element referred to herein:

1 Clamping Channel
2 Shell Clamp Ring
3 Shell Wall
4 Lid Clamp Ring
5 Lid Wall
**6*a*** O-Ring Uncompressed
**6*b*** O-Ring Compressed
7 Clamp Ring Welds
8 Lid Lift Mechanism
9 Primary Safety Lock Mechanism
10 Secondary Safety Lock Mechanism
11 Tensioning Cam Plate
**12*a*** Cam Pin Standard Clevis
**12*b*** Cam Pin Adjustment Clevis
13 Cam Pin
**14*a*** Cam Pin Clevis Fixed-Pivot Guide Plate
**14*b*** Cam Pin Clevis Floating-Pivot Guide Plate
15 Tensioning Lever Rod
16 Tension Adjustment Mechanism
17 Cam Pivot Pin
**18*a*** Primary Safety Lock Release Pin Closed
**18*b*** Primary Safety Lock Release Pin Open
19 Cam Pin Clevis Guide Plate Shell Mounting Bracket
20 Quick Closure Mechanism
21 Tension Adjustment Screw Mounting Lug
22 Tension Adjustment Screw
23 Tension Adjustment Nut
24 Cam Pin Adjustment Clevis Slide Pin
25 Cam Pin Restraint Fastener
26 Clamping Block Ring Plate
27 Clamping Block
28 Clamping Block Mounting Screw
29 Clevis or Lug Weld Bead
30 Adjustable Clamp Ring Subassembly
31 Standard Clamp Ring Subassembly
32 Clamping Channel WRT Shell and Lid Rings Clearance
33 Typical Taper Angle for Clamping Mated Components
**34*a*** Cam Pin Clevis Guide Plate Fixed-Pivot Hole
**34*b*** Cam Pin Clevis Guide Plate Floating-Pivot Slot
35 Cam Pin Clevis Guide Adjustable Mounting Holes
36 Clamping Channel Forward Support Bracket
37 Lid Lift Mechanism Support Bracket
38 Cam Pin Adjustment Clevis Slide Pin Slot
39 Clamping Channel Flat Surface for Cam Pin Clevis Mounting
40 Adjustable Clamp Block Subassembly
41 Standard Clamp Block Subassembly
42 Shell Assembly
43 Lid Assembly
50 Cam Plate Pin Guide
51 Cam Plate Pivot Hole
52 Cam Plate Safety Lock Lever Groove
53 Cam Plate Safety Lock Spring Pin Hole
54 Cam Plate Tensioning Lever Rod Seat
55 Cam Closed Position Safety Range Angle
56 Primary Safety Lock Lever
57 Primary Safety Lock Lever Mounting Bracket
58 Primary Safety Lock Linkage Arm
59 Safety Valve
**60*a*** Safety Valve Lever Closed
**60*b* Safety Valve Lever Open With reference to FIG. 1, a pressurized vessel is comprised of a shell assembly 42 and a lid assembly 43 wherein the vessel is represented as closed. Under normal operating conditions the vessel must be opened and closed repeatedly to access its internal components where the lid lift mechanism 8 counterbalances the weight of the lid during said procedures. To contain vessel pressure safely during operation, a quick closure mechanism 20 is provided to ensure that the lid assembly 43 remains firmly sealed to the shell assembly 42 by the application of tension along the rim perimeter. The said quick closure mechanism 20 is represented as in a fully tensioned state. Also illustrated in FIG. 1 are two different safety lock mechanisms; a primary mechanism 9 which associates the release of the quick closure mechanism 20 with a pressure relief valve, and a secondary mechanism 10 which prevents the tensioning mechanism from activation until a pin is removed as shown in Detail 1**.

Figure 2:
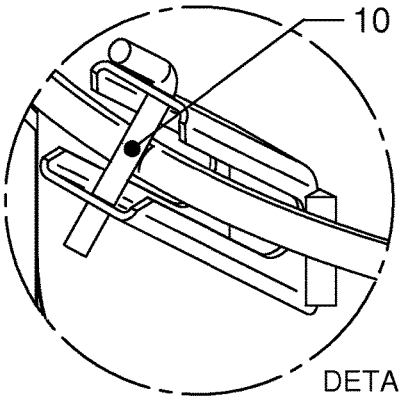
FIG. 2 is a section view of the clamping arrangement which mates the lid ring with the shell ring of a pressure vessel in a closed state.
Figure 2:
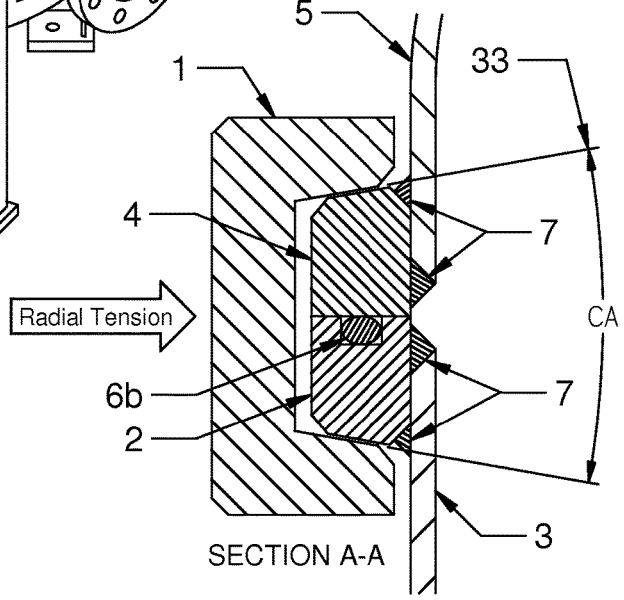

The nature of the seal maintained between the shell assembly 42 and the lid assembly 43 is illustrated in FIG. 2 which represents a section through the rim of the vessel at the plane of the seal between shell and lid. The vessel shell 3 is equipped with a circular clamp ring 2 attached to the shell with weld beads 7. The vessel lid 5 is equipped with a circular lid clamp ring 4 attached to the lid also with weld beads 7. Radial tension is exerted by action of the quick closure mechanism 20 to draw two clamping channels 1 in a horizontal plane toward the center of the vessel. With force applied along the inclines 33 representing a typical taper angle for clamping mated components, the lid ring 4 is brought into firm contact with the shell ring 2, compressing the O-ring 6*b* to act as a pressure seal.

Figure 3:
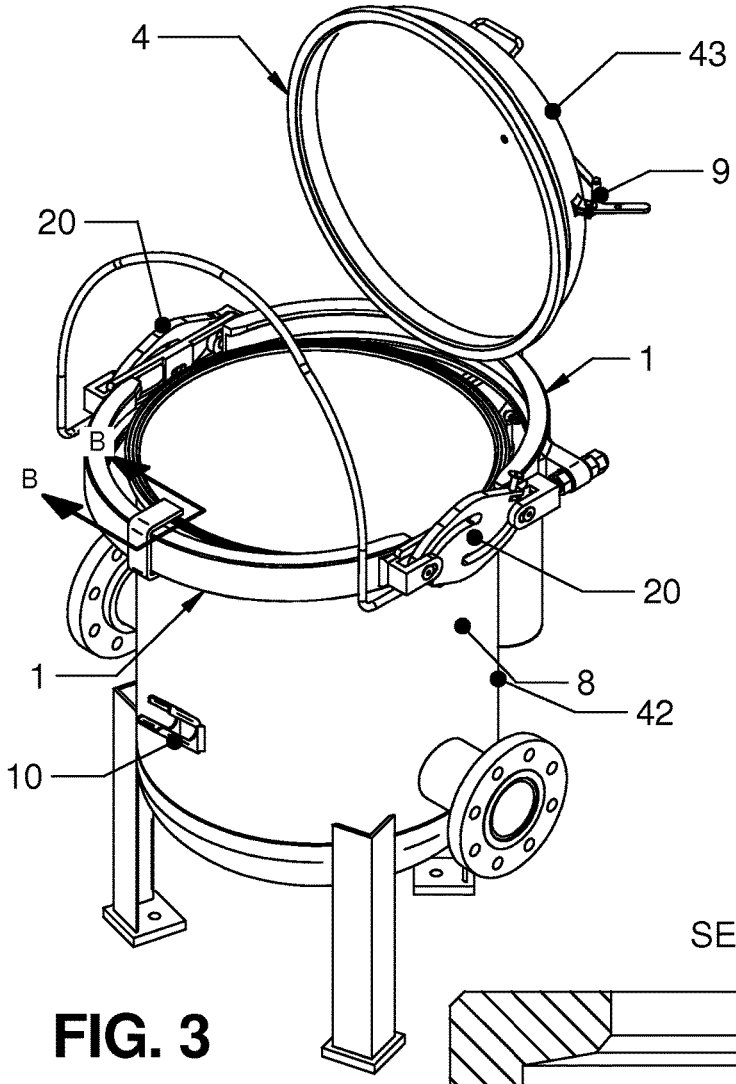
FIG. 3 is a perspective view of a typical open-lid vessel equipped with the cam-actuated closure mechanism.
Figure 4:
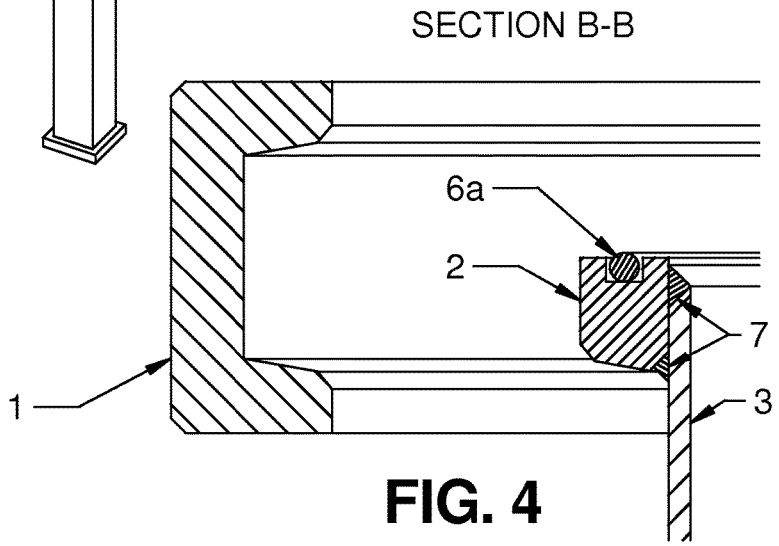
FIG. 4 is a section view of the clamping component retracted from engagement with the lid and shell rings, showing only the shell ring as the lid ring is pivoted up and out of sight.

FIG. 3 presents the aforementioned pressure vessel in the fully open state wherein the lid assembly 43 has been rotated upward about a pivot point incorporated in the aforementioned lid lift mechanism 8. In this state the vessel internal components are accessible. The quick closure mechanism 20 is represented as in fully relaxed state wherein the clamping ring 1 is now displaced radially outward to enable separation of the lid assembly 43 from the shell assembly 42. FIG. 4 represents a section through the rim of the vessel at the horizontal plane of the top surface of the shell clamping ring 2. In this instance, the clamping channel 1 is withdrawn from contact with the shell clamping ring 2 and the lid clamping ring 4 such that the lid assembly 43 may be pivoted up into the vessel-open state. The same illustration shows that the O-ring 6*a* is now uncompressed.

Figure 5:
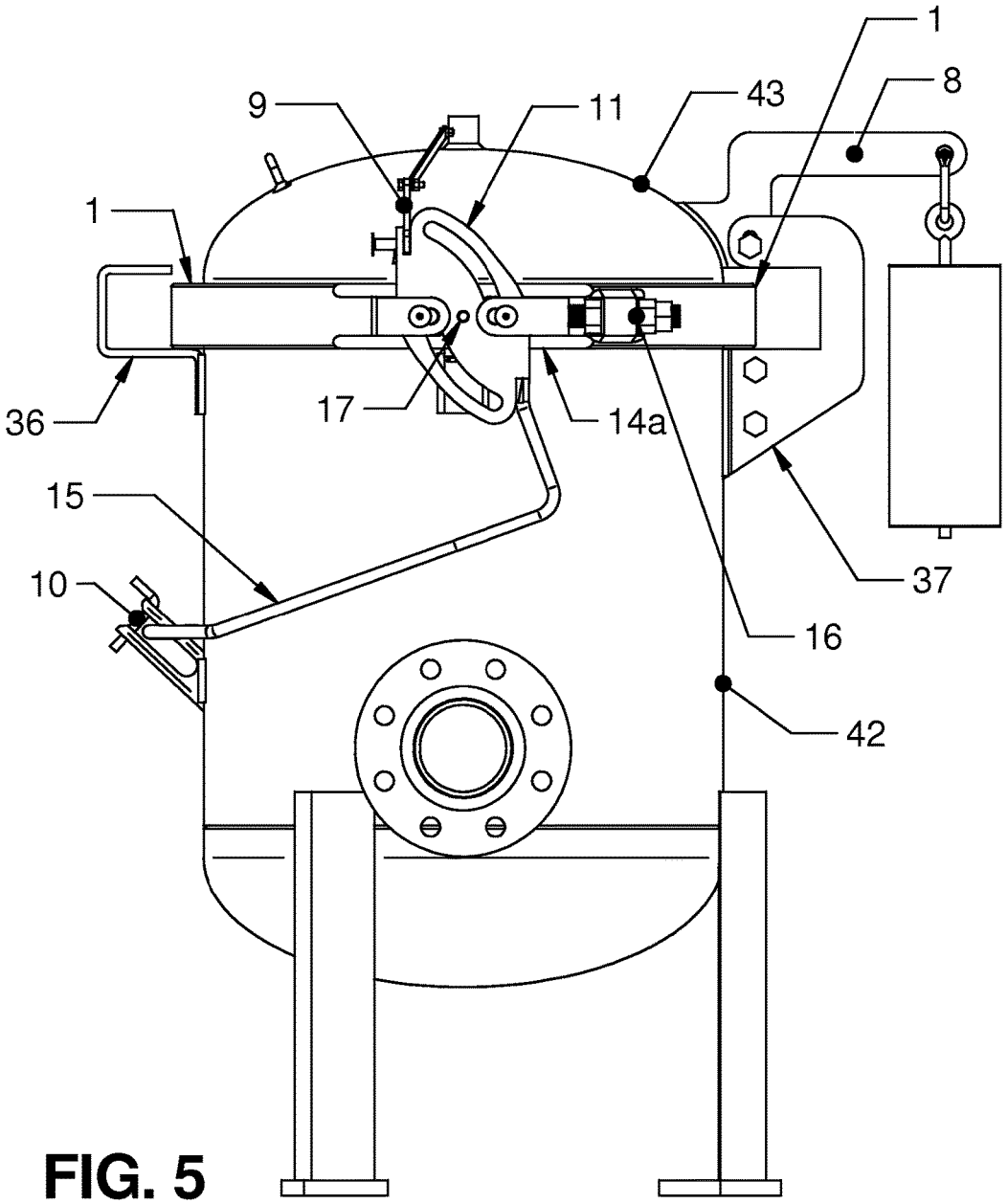
FIG. 5 is a side view of a typical closed-lid vessel with annotation identifying key elements of the vessel and closure mechanism.

FIG. 5 is a side view of the aforementioned pressurized vessel in the closed state. Key elements of the quick closure mechanism 20 are identified for further explanation of the function of the invention. The tensioning cam plate 11 may be made to rotate about the cam pivot pin 17 by application of manual force using a tensioning lever rod 15 if the primary and secondary safety lock mechanisms 9 and 10 respectively are defeated. In this illustration, both clamping channels 1 are fully tensioned, causing the shell clamping ring 2 and the lid clamping ring 4 to be in full contact around the perimeter of the vessel.

Figure 6:
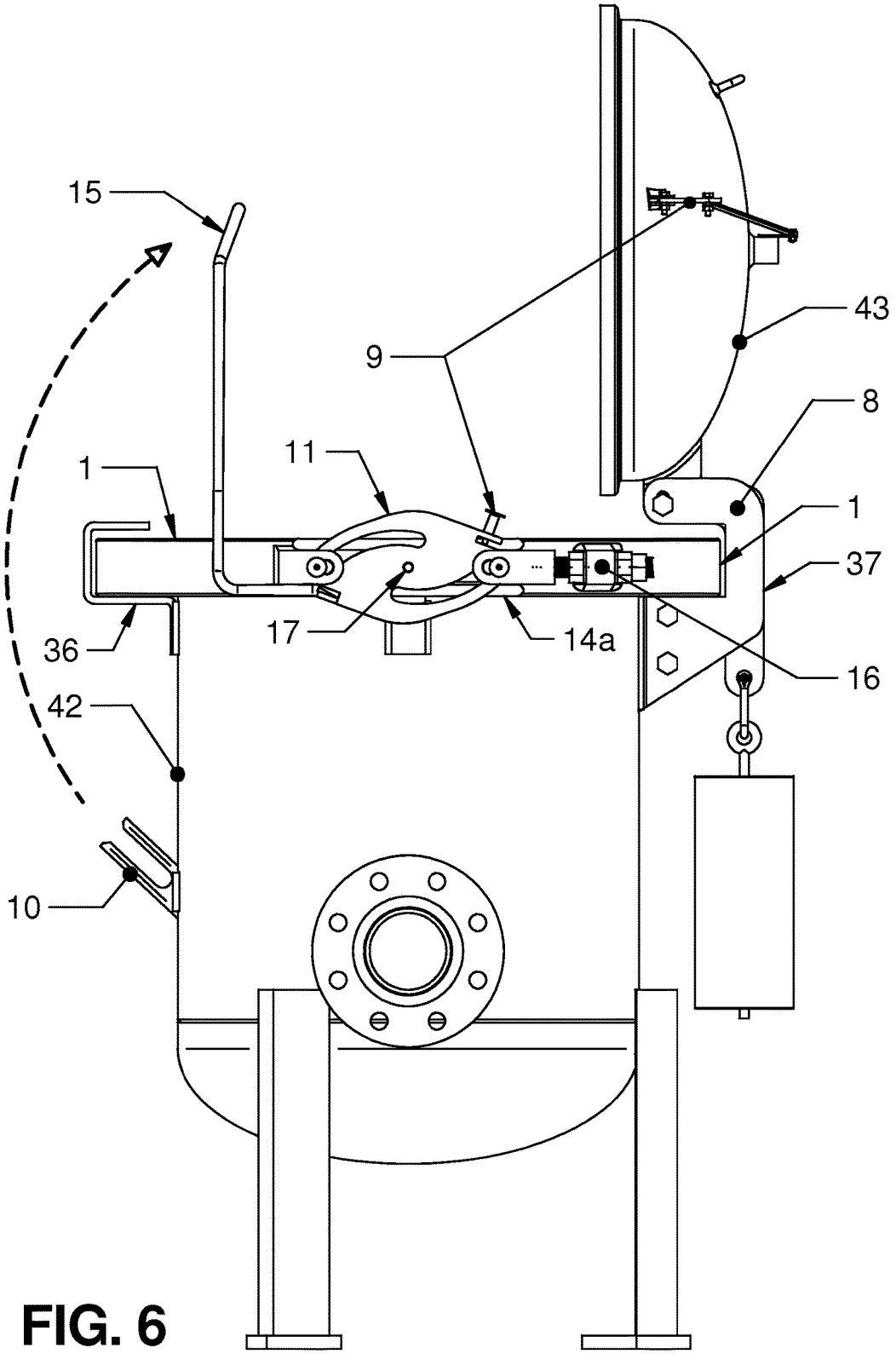
FIG. 6 is a side view of a typical open-lid vessel with annotation identifying key elements of the vessel and closure mechanism.

FIG. 6 is a side view of the aforementioned pressurized vessel in the open state. Primary and secondary safety lock mechanisms 9 and 10 respectively have been defeated to permit activation of the quick closure mechanism 20. In this case, the tensioning cam plate 11 has been rotated to its clockwise limit through application of manual force to the tensioning lever rod 15, causing both clamping channels 1 to withdraw radially outward from contact with the shell clamping ring 2 and the lid clamping ring 4, allowing the lid assembly 43 to be pivoted upward. During movement outward, the clamping channel 1 at left is maintained in the horizontal plane by a clamping ring forward support bracket 36 and the clamping channel 1 at right is similarly guided by a lid lift mechanism support bracket 37. Also referenced is a cam pin clevis fixed-pivot guide plate 14*a* which ensures that the tensioned elements of both clamping channels 1 remain in the horizontal plane throughout activation of the quick closure mechanism.

Figure 7:
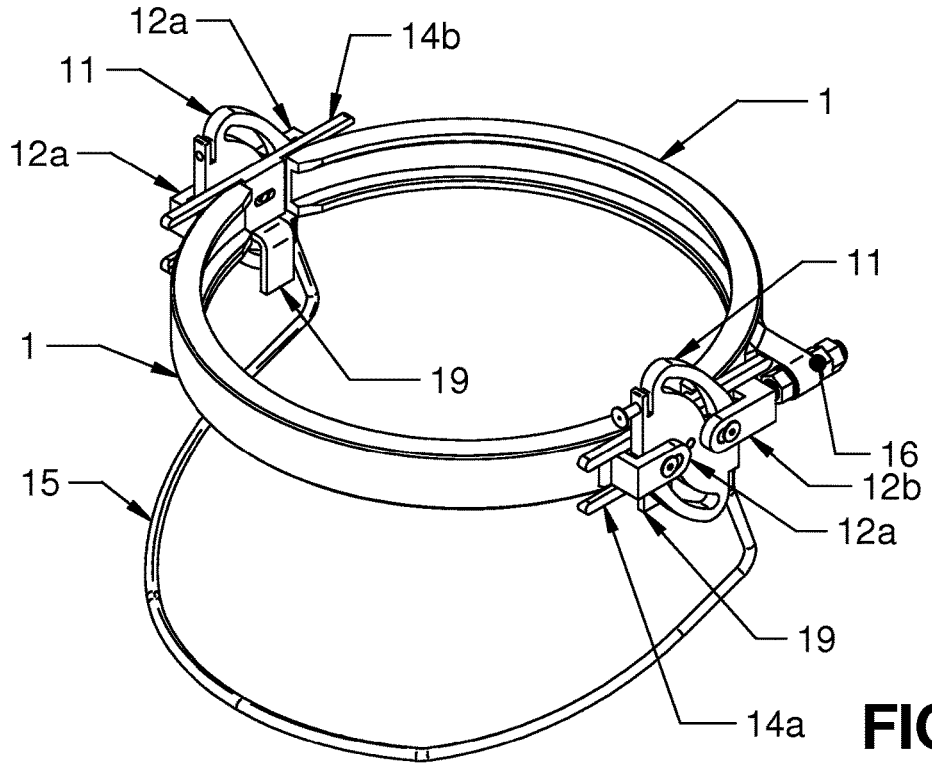
FIG. 7 is a perspective view of the closure mechanism and clamping ring subassemblies in lid-closed position.

FIG. 7 is a perspective view of the present invention isolated from the aforementioned pressurized vessel, identifying key elements of the design. The closure mechanism is mounted on two brackets 19 which are in turn welded to the vessel shell wall 3. The closure mechanism 20 is illustrated in the tensioned state where two tensioning cam plates 11 are applying maximum closure force on two balanced clamping channels 1 with a manually operated tensioning lever rod 15 in the extreme downward position. Further attention is drawn to three cam pin standard clevises 12*a* and one cam pin adjustment clevis 12*b*, all of which are welded to the ends of the clamping channels 1. The clevises incorporate cylindrical pins which ride on symmetrical cam surfaces in the aforementioned tensioning cam plates 11. The said clevises move horizontally, constrained by the cam pin clevis fixed-pivot guide plate 14*a* and the cam pin clevis floating-pivot guide plate 14*b*. A tension adjustment mechanism 16 is used to accommodate manufacturing tolerances to enable assembly of the closure mechanism with precise control over final compression of the lid clamping ring 4 with respect to shell clamping ring 2 when the device is in the fully tensioned state.

Figure 8:
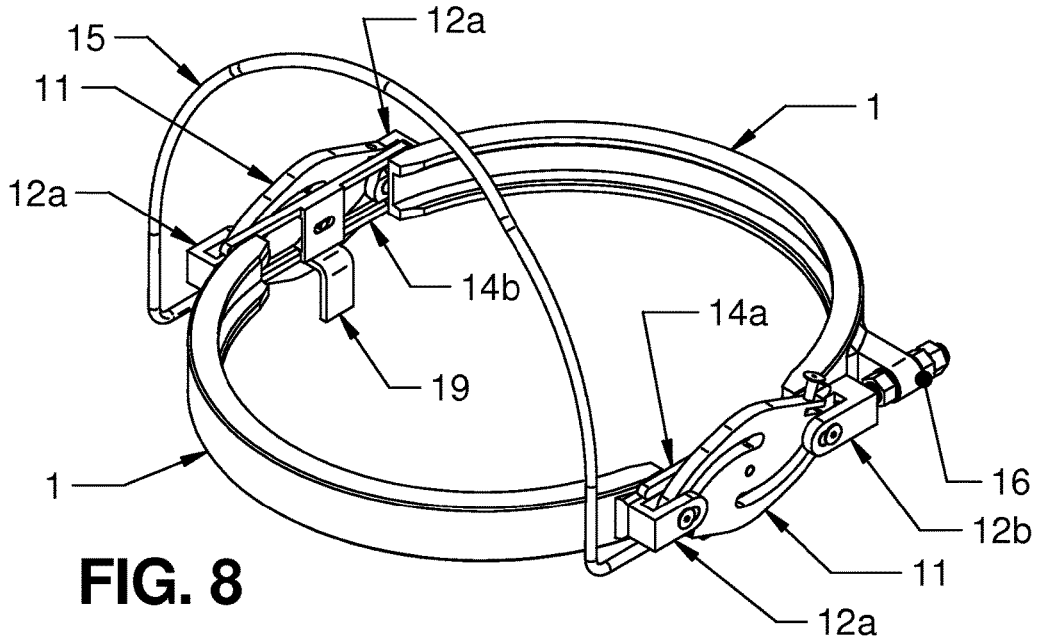
FIG. 8 is a perspective view of the closure mechanism and clamping ring subassemblies in lid-open position.

FIG. 8 is a perspective view of the present invention, isolated from the aforementioned pressure vessel, in this case in the tension-free state. Now the tensioning cam plates 11 have been rotated clockwise to their fullest extent and the two clamping channels 1 have been withdrawn radially with sufficient displacement to allow the lid clamp ring 4 to disengage, thereby enabling opening of the vessel.

Figure 9:
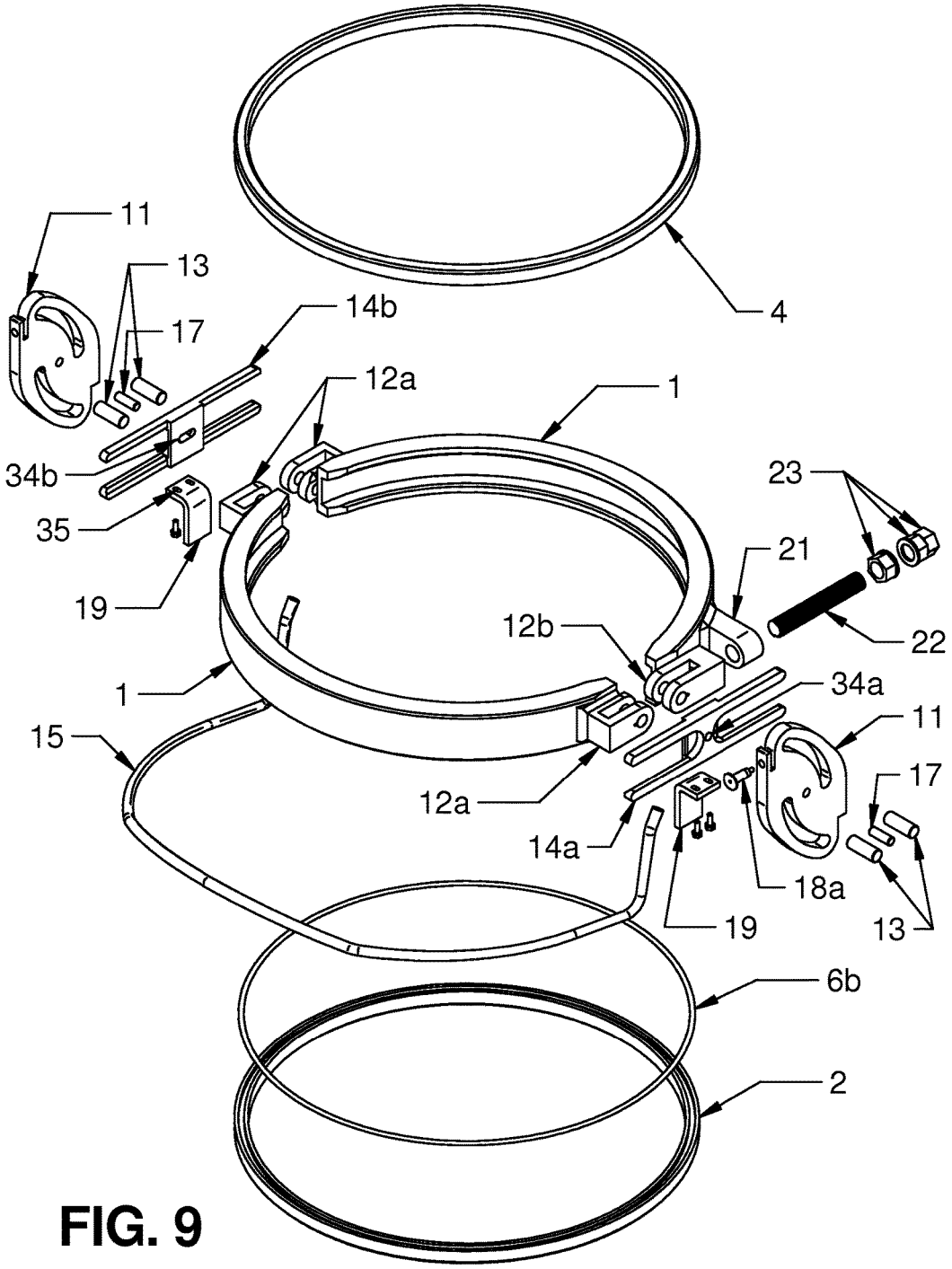
FIG. 9 is a perspective exploded view of the components of the cam-actuated closure system.

FIG. 9 is an exploded perspective view of the quick closure mechanism and related elements. In the closed state, the system incorporates a shell clamping ring 2 and its O-ring 6*b* mated with a lid clamping ring 4 in contact in the horizontal plane, forced into engagement by two clamping channels 1. When rotated about the axes of the cam pivot pins 17, the two tensioning cam plates 11 apply contracting force on the perimeter of the pressure vessel rim by cam action of curved slots which engage pins 13 embodied in three cam pin standard clevises 12*a* and one cam pin adjustment clevis 12*b*. A cam pin clevis fixed-pivot guide plate 14*a* and a cam pin clevis floating-pivot guide plate 14*b* provide alignment of the two separate clamping channels 1 in the horizontal plane during contraction or expansion of the assembled mechanism.

Machining and welding procedures employed to fabricate the quick closure system typically result in dimensional variations in components. Again in reference to FIG. 9, two design features accommodate these variations;

i) Two cam pin clevis guide plate shell mounting brackets 19 are welded to the pressure vessel shell 3. The said brackets are equipped with adjustable mounting holes, or slots, which enable fastening of the two cam pin clevis guide plates 14*a* and 14*b* at variable distances offset from the vessel shell.

ii) The final assembly of the quick closure mechanism depends on establishing correct component displacements on the perimeter of the pressure vessel using a tension adjustment screw 22 which threads into the cam pin adjustment clevis 12*b* and passes through a tension adjustment screw mounting lug 21. Three tension adjustment nuts 23 are turned as needed to set the correct displacements for proper operation of the said quick closure mechanism 20.

Figure 10:
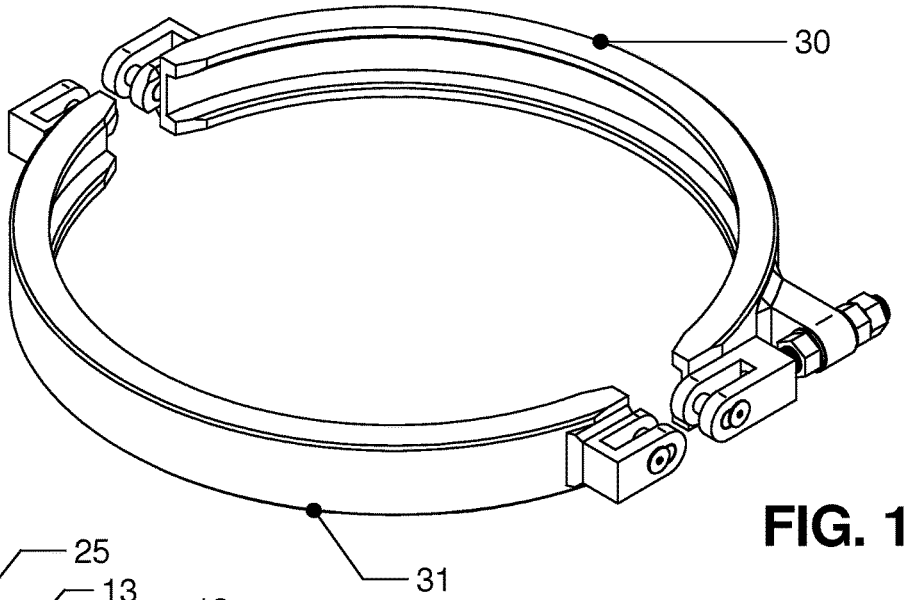
FIG. 10 is a perspective view of the arrangement of two continuous clamping rings which engage with the lid and shell lip rings.
Figure 11:
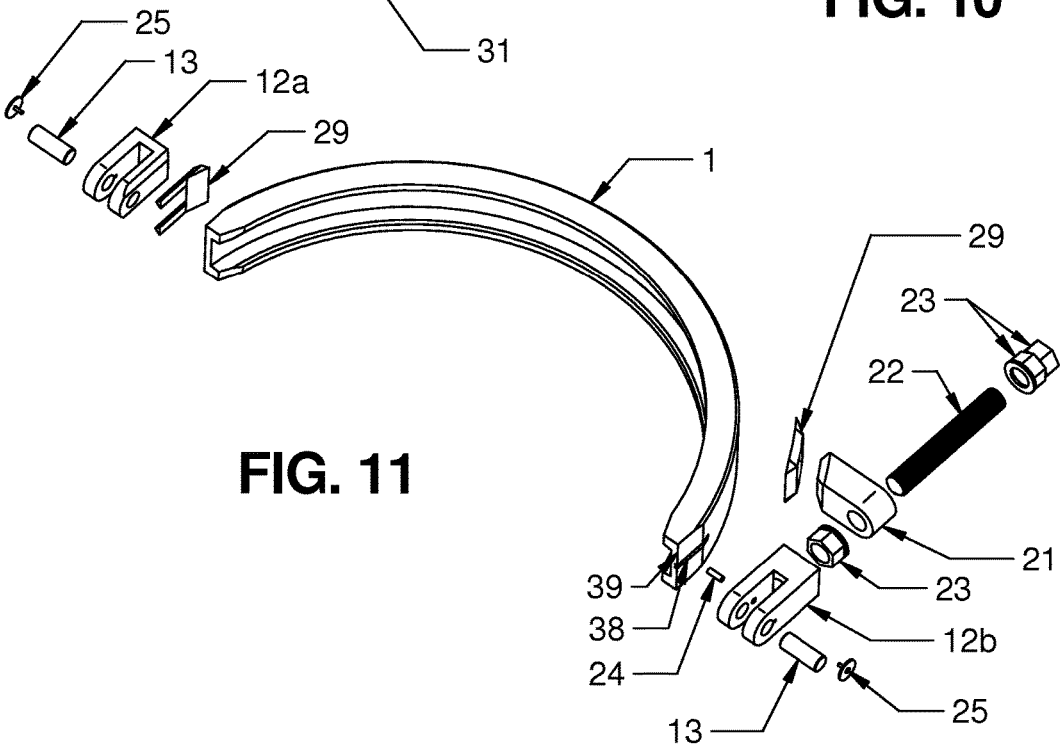
FIG. 11 is a perspective exploded view of the components of one of the continuous clamping rings illustrated in FIG. 10.
Figure 12:
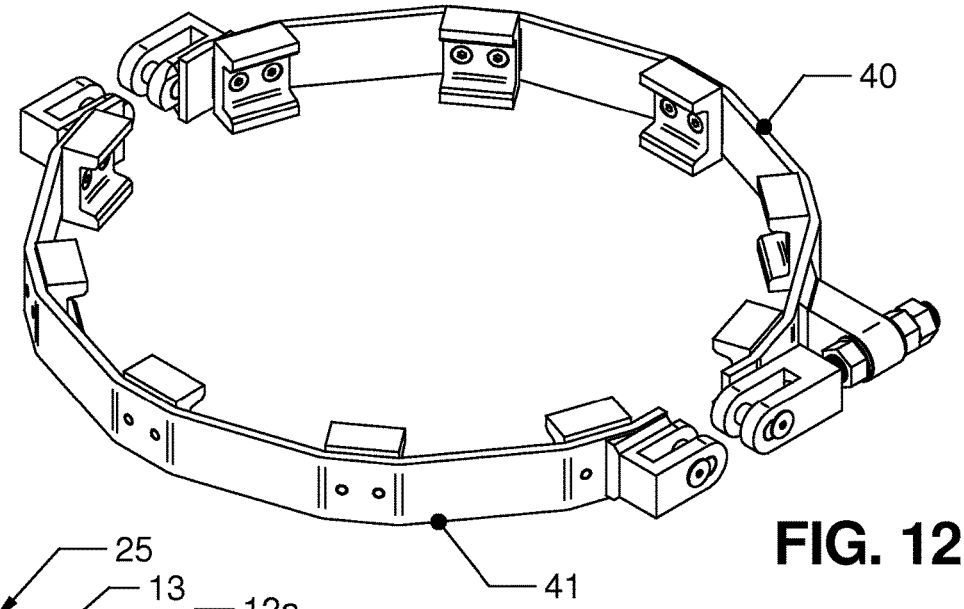
FIG. 12 is a perspective view of the arrangement of two clamping rings with a plurality of machined blocks which engage with the lid and shell lip rings.
Figure 13:
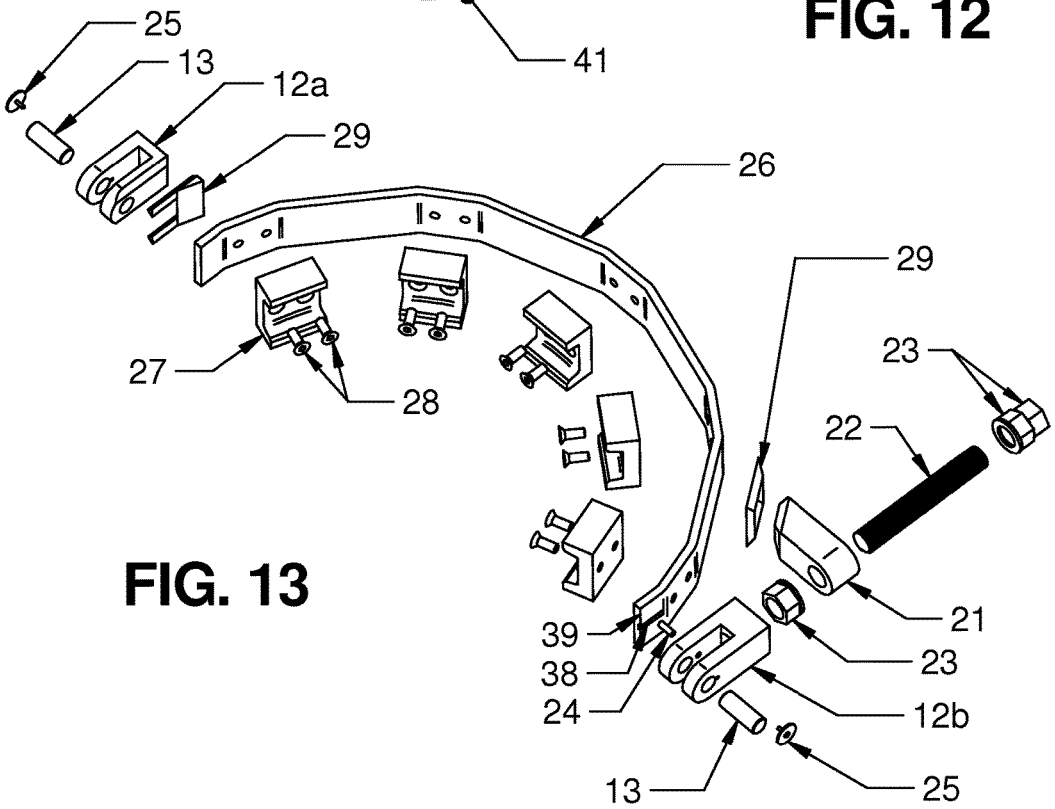
FIG. 13 is a perspective exploded view of the components of one of the clamping rings with a plurality of machine blocks illustrated in FIG. 12.

The present invention provides for multiple configurations of rim clamping devices. Two such possibilities are illustrated as follows;

i) Per FIG. 10, the active clamping action at the pressure vessel rim is applied by a semi-circular metal bar (clamping channel 1) where its internal faces have been machined on a lathe to conform to the shapes of the mating shell clamp ring 2 and the lid clamp ring 4 as depicted in FIG. 2. FIG. 10 illustrates the pairing of two such design elements, an adjustable clamp ring subassembly 30 and a standard clamp ring subassembly 31, wherein the said subassemblies are drawn together radially inward during activation of the quick closure mechanism. Further detail regarding the manufacture of the adjustable clamp ring subassembly 30 is illustrated in FIG. 11 which is an exploded perspective view of the elements of the design. At one end of the clamping channel 1 a cam pin standard clevis 12*a* is affixed to a flattened surface with a weld bead 29. The cam pin 13 is mounted through the holes of the said clevis and retained in place with a cam pin restraint fastener 25. At the opposite end of the clamping channel 1 a tension adjustment screw mounting lug 21 is affixed to the said clamping channel's exterior cylindrical surface with a weld bead 29 at a suitable distance from the adjacent said clamping channel end. The tension adjustment screw 22 passes through the hole in the aforementioned mounting lug and is fastened to the cam pin adjustment clevis 12*b* which bears a mating internal thread. The corresponding end of the clamping channel 1 bears a flat surface 39 and a slot 38 which is engaged by a cam pin adjustment clevis slide pin 24 which in turn is mounted in the said cam pin adjustment clevis 12*b*. The said slide pin ensures continued proper alignment of the cam pin adjustment clevis 12*b* during installation of the quick closure mechanism as the tension adjustment nuts 23 are tightened to set appropriate closed device tension. The cam pin 13 is mounted through the holes of the cam pin adjustment clevis 12*b* and retained in place with the cam pin restraint fastener 25.

ii) Per FIG. 12, the active clamping action at the pressure vessel rim is applied by a plurality of metal blocks 27 each of which has its internal faces machined on a 3-axis CNC milling machine to conform to the shapes of the mating shell clamp ring 2 and the lid clamp ring 4 as depicted in FIG. 2. The said metal blocks are mounted on a clamping block ring plate 26 with machined internal faces oriented radially inward. FIG. 12 illustrates the pairing of two such design elements, an adjustable clamp block subassembly 40 and a standard clamp block subassembly 41, wherein the said subassemblies are drawn together radially inward during activation of the quick closure mechanism. Further detail regarding the manufacture of the adjustable clamp block subassembly 40 is illustrated in FIG. 13 which is an exploded perspective view of the elements of the design. A clamping block ring plate 26 is formed with flat segments arranged to mate with the flat rear face of each of the appropriate number of the clamping blocks 27, the number of which is variable depending on the requirements of pressure vessel design. Each clamping block 27 is mounted to the clamping block ring plate 26 with two countersunk screws 28 which are threaded into tapped holes in the said ring plate. At one end of clamping block ring plate 26 a cam pin standard clevis 12*a* is affixed to the outer surface with a weld bead 29. The cam pin 13 is mounted through the holes of the said clevis and retained in place with a cam pin restraint fastener 25. At the opposite end of the clamping block ring plate 26 a tension adjustment screw mounting lug 21 is affixed to the said ring plate's exterior surface with a weld bead 29 at a suitable distance from the adjacent said ring plate end. A tension adjustment screw 22 passes through the hole in the aforementioned mounting lug and is fastened to the cam pin adjustment clevis 12*b* which bears a mating internal thread. The corresponding end of the clamping block ring plate 26 bears a flat surface 39 and a slot 38 which is engaged by the cam pin adjustment clevis slide pin 24 which in turn is mounted in the said cam pin adjustment clevis 12*b*. The said slide pin ensures continued proper alignment of the cam pin adjustment clevis 12*b* during installation of the quick closure mechanism 20 as the tension adjustment nuts 23 are tightened to set appropriate closed-device tension. A cam pin 13 is mounted through the holes of the cam pin adjustment clevis 12*b* and retained in place with a cam pin restraint fastener 25.

Figure 14:
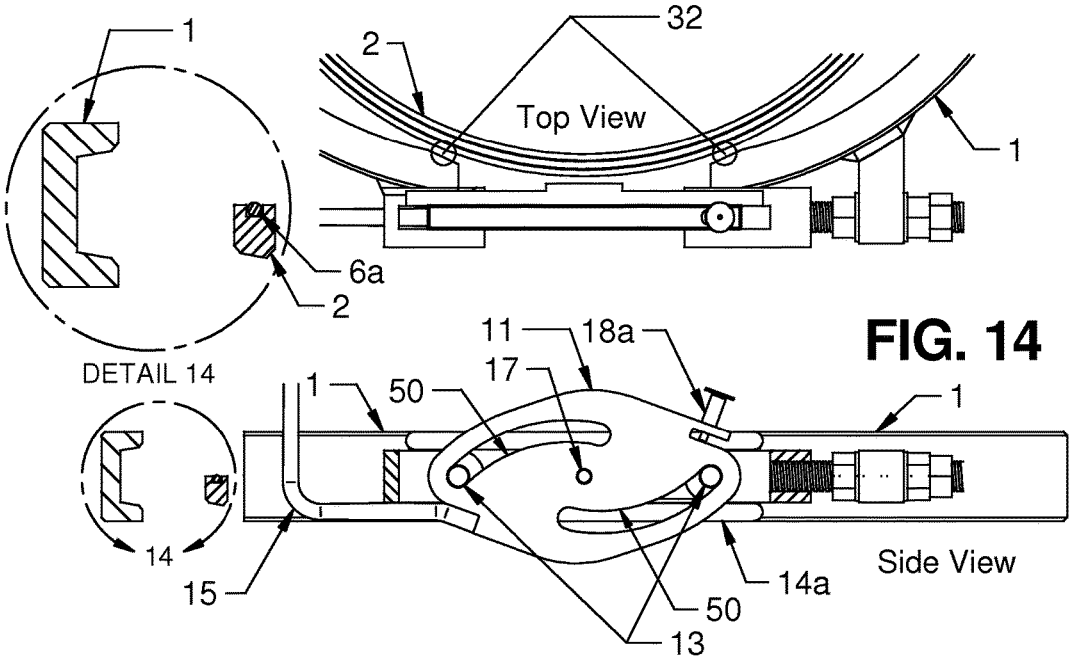
FIG. 14 is a side and top view with section detail of the closure mechanism fully open to enable the release of shell and lid clamped rings with the lip ring pivoted out of range.
Figure 15:
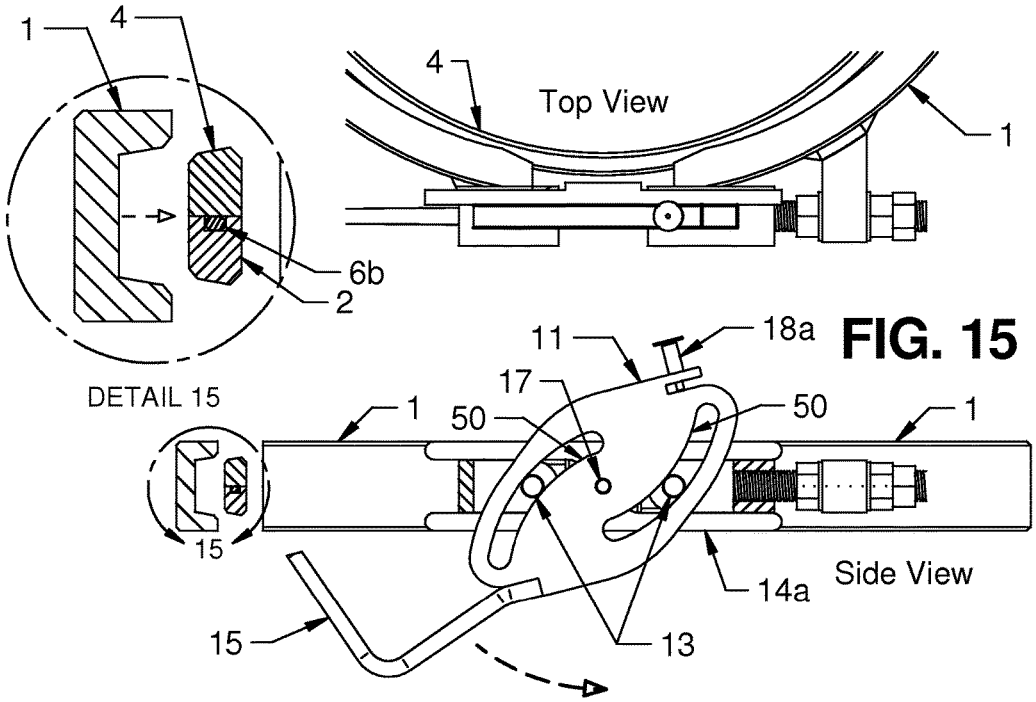
FIG. 15 is a side and top view with section detail of the closure mechanism halfway actuated to full closure of shell and lid clamped rings.
Figure 16:
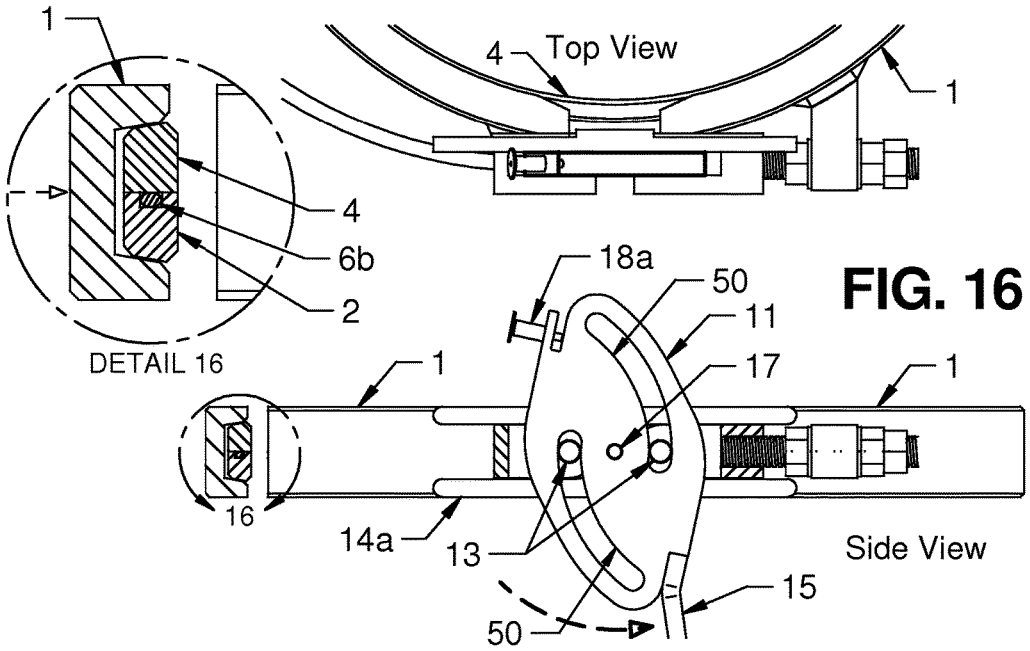
FIG. 16 is a side and top view with section detail of the closure mechanism illustrating the rotational point at which protection is now available from unintended release of tension to vessel pressure.
Figure 17:
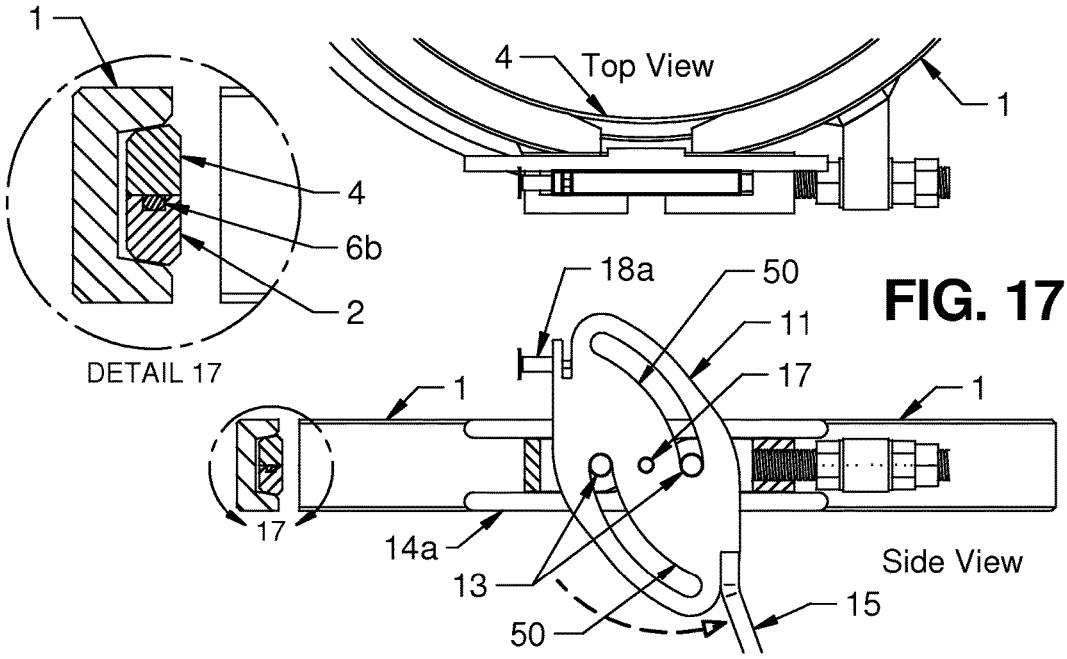
FIG. 17 is a side and top view with section detail of the closure mechanism in the fully closed position.

In reference to FIGS. 14, 15, 16, and 17, actuation of the quick closure mechanism 20 is hereby described in detail. In each Side View, described rotation is about the cam pivot pin 17. The foremost legs of the cam pin standard clevis 12*a* and the cam pin adjustment clevis 12*b* are cut away for clarity;

i) FIG. 14 presents top and side views wherein the said closure mechanism 20 is in the fully relaxed state. The Side View shows the tensioning cam plate 11 with two cam pins 13 residing at the extreme range of rotation within the cam plate cam guides 50. Detail 14 illustrates clamping channel 1 withdrawn radially away from the vessel center and shell clamping ring 2 is exposed with the O-ring 6*a* resting in its groove in an uncompressed state. The lid clamping ring 4 is not shown as it is rotated up and out of view as part of the lid assembly 43 during opening of the vessel. The Top View shows clamping channel 1 clearance 32 with respect to the shell clamp ring 2 and the lid clamp ring 4, enabling unobstructed lifting of the lid assembly 43.

ii) FIG. 15 presents top and side views wherein the tensioning cam plate 11 of the said closure mechanism 20 has rotated through half its possible range under the influence of manual effort applied to the tensioning lever rod 15. As the said plate rotates in a counter clockwise direction, two cam pins 13 slide along surfaces in the cam plate pin guides 50 and with symmetric arrangement of the said pin guides, both clamping channels 1 approach radially toward the center of the pressure vessel at matching rates of displacement. Detail 15 shows a clamping channel 1 approaching engagement in the horizontal plane with the mated shell clamp ring 2 and lid clamp ring 4. The Top View illustrates how the clamping channel 1 now overlaps the lid clamp ring 4, obstructing lifting of the vessel lid assembly 43.

iii) FIG. 16 presents top and side views wherein the tensioning cam plate 11 has been rotated to the point of closest approach of the ends of the two clamping channels 1. It is to be noted that the cam pins 13 are not yet at the extent of their range in the cam plate pin guides 50. This design characteristic of the present invention represents a significant safety condition wherein there is a continuing range of rotation of the tensioning cam plate 11 where no resolved force exists on the cam surfaces tending to permit the quick closure mechanism 20 to relax tension on the clamping channels 1. Detail 16 illustrates that full closure has been achieved with a clamping channel 1 now engaged with the shell clamp ring 2 and the lid clamp ring 4 and the O-Ring 6*b* is fully compressed to maintain an effective vessel pressure.

iv) FIG. 17 presents top and side views wherein the tensioning cam plate 11 is now fully rotated counter clockwise. The cam pins 13 are positioned at the extreme range of rotation along the cam surfaces of the cam plate pin guides 50. Any degree of rotation between the fully rotated state and the previous state illustrated in FIG. 16 maintains full tension on the adjustable clamp ring assembly 30 and the standard clamp ring assembly 31. Similarly, in the application of the design variation as depicted in FIG. 12, this tensioning cam plate state maintains full tension on the an adjustable clamp block assembly 40 and a standard clamp block assembly 41. The FIG. 17 Top View and Detail 17 depict plan and section views of the quick closure system identical to those of the FIG. 16 Top View and Detail 16 respectively.

In reference to FIG. 18, the key element of the present invention is represented; a tensioning cam plate 11. This component is configured to embody a rotational center point where a cam pivot pin 17 is fitted into the cam plate pivot hole 51. This said pin is constrained to rotate in a corresponding hole in a cam pin clevis fixed-pivot guide plate 14*a* (not shown) or a cam pin clevis floating-pivot guide plate 14*b* (not shown). Two cam pins 13 (not shown) ride on two cam surfaces in cam plate pin guides 50. The said cam pins are mounted in clevises (not shown) which are in turn welded to clamping channels 1 (not shown) or clamping block ring plates 26 (not shown). As the tensioning cam plate 11 is rotated, the aforementioned cam pins 13 are drawn together or drawn apart, depending on the sense of rotation. Using conventional engineering design principles, the shape of the cam plate pin guides 50 may be devised to apply appropriate mechanical advantage at various stages in the rotational state of the said tensioning cam plate. Engineering principles also apply to selection of tensioning cam plate 11 material thickness and bulk of material encompassing the layout of the cam plate pin guides 50, where such principles ensure that the quick closure mechanism 20 (not shown) may withstand the tensile forces of the vessel rim clamping system subject to internal vessel pressure.

Also in reference to FIG. 18, three further design features of the tensioning cam plate 11 are noteworthy;

i) The cam closed-position safety range angle 55 represents a portion of the cam plate pin guides 50 where the cam surfaces are concentric with the cam plate pivot hole 51. This design characteristic ensures that when the cam pins 13 (not shown) are riding on said cam surfaces in this area, forces tending to separate the said cam pins do not resolve to create force vectors which would tend to drive the said cam pins toward the opposite extreme of the said cam plate pin guides, a condition which could result in unintended release of the quick closure mechanism 20.

ii) A cam plate safety lock clasp groove 52 is incorporated to provide a positive restraint against unintended rotation of the tensioning cam plate 11. A cam plate safety lock spring pin hole is also featured for mounting a primary safety lock release pin 18*a* (not shown). (These features are described in detail with reference to FIG. 21 and FIG. 21.)

iii) A cam plate tensioning lever rod seat 54 is incorporated to provide a reference flat surface for welding the ends of a tensioning lever rod 15 (not shown) to a pair of tensioning cam plates 11 for installation in a complete quick closure mechanism 20 as depicted in FIG. 7 and FIG. 8.

Figure 19:
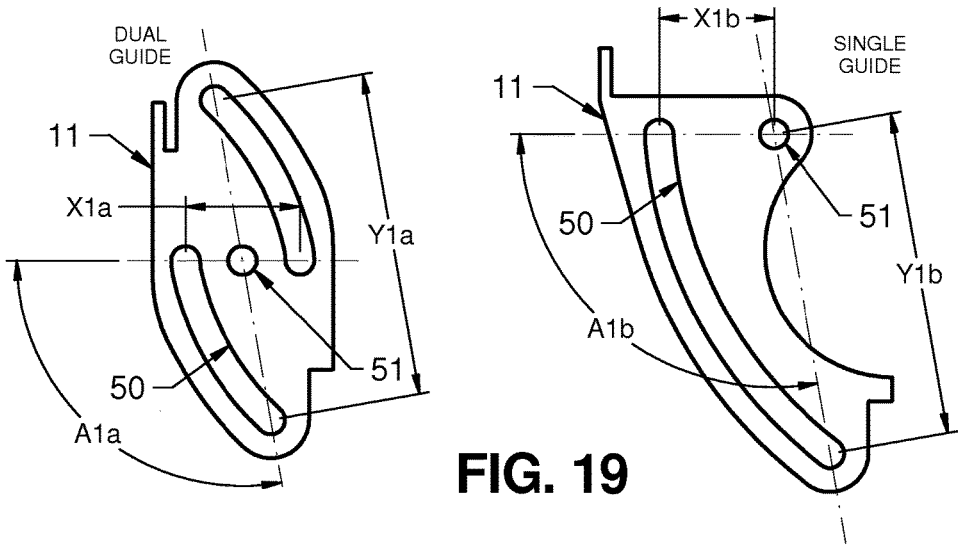
FIG. 19 is a second possible configuration of the cam plate illustrating both dual and single cam action for a specific rotation angle with variable closed and open separation distances for two clamping ring subassemblies.
Figure 20:
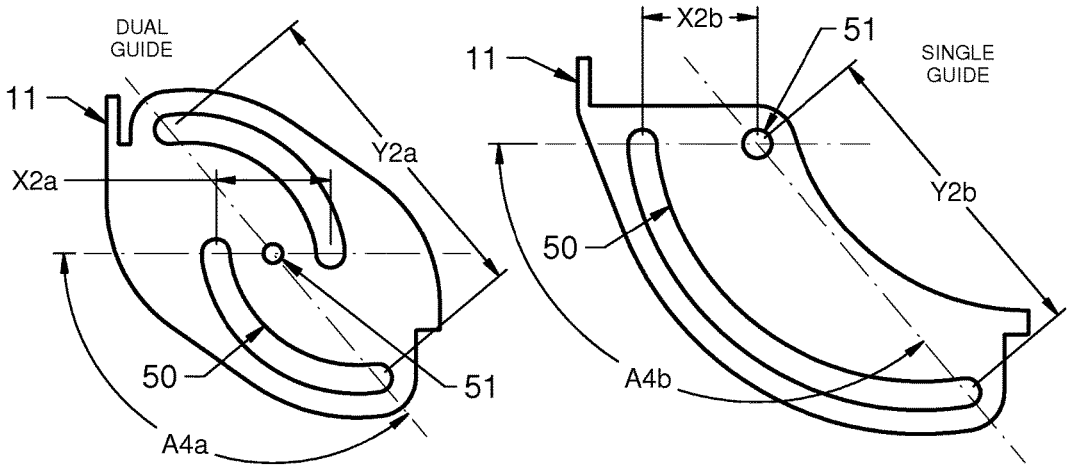
FIG. 20 is a third possible configuration of the cam plate illustrating both dual and single cam action for another specific rotation angle with variable closed and open separation distances for two clamping ring subassemblies.

Virtually infinite variations in tensioning cam plate 11 design are possible within the definition of uniqueness of the present invention. FIG. 19 illustrates two different tensioning cam plate 11 configurations where dimension X represents the distance of closest approach of two cam pins 13 (not shown), dimension Y represents the distance of farthest separation of the said cam pins, and angle A represents the degree of said tensioning cam plate rotation necessary for engaged said cam pins to undergo the full range of relative movement. The primary design configuration applied to describe the present invention is referred to as 'dual guide' wherein two aforementioned cam pins are engaged in two cam plate pin guides 50 arranged symmetrically with a central cam plate hole 51 as a rotational axis in the said tensioning cam plate. An alternative is referred to as 'single guide' where a single cam pin 13 (not shown) slides on a cam surface in a single cam plate pin guide 50 with a cam plate pivot hole 51 rotational axis, such configuration requiring appropriate design modifications to the other elements of the quick closure mechanism 20. FIG. 19 illustrates how the said 'dual guide' and 'single guide' configurations provide similar functionality in the context of the present invention where dimensions X1*a* and X1*b* are equal, dimensions Y1*a* and Y1*b* are equal, and angles A1*a* and A1*b* are equal. FIG. 20 is a further example of a similar relationship between 'dual guide' and 'single guide' tensioning cam plate 11 designs where the angles of rotation A2*a* and A2*b* are greater than those of FIG. 19.

Figure 21:
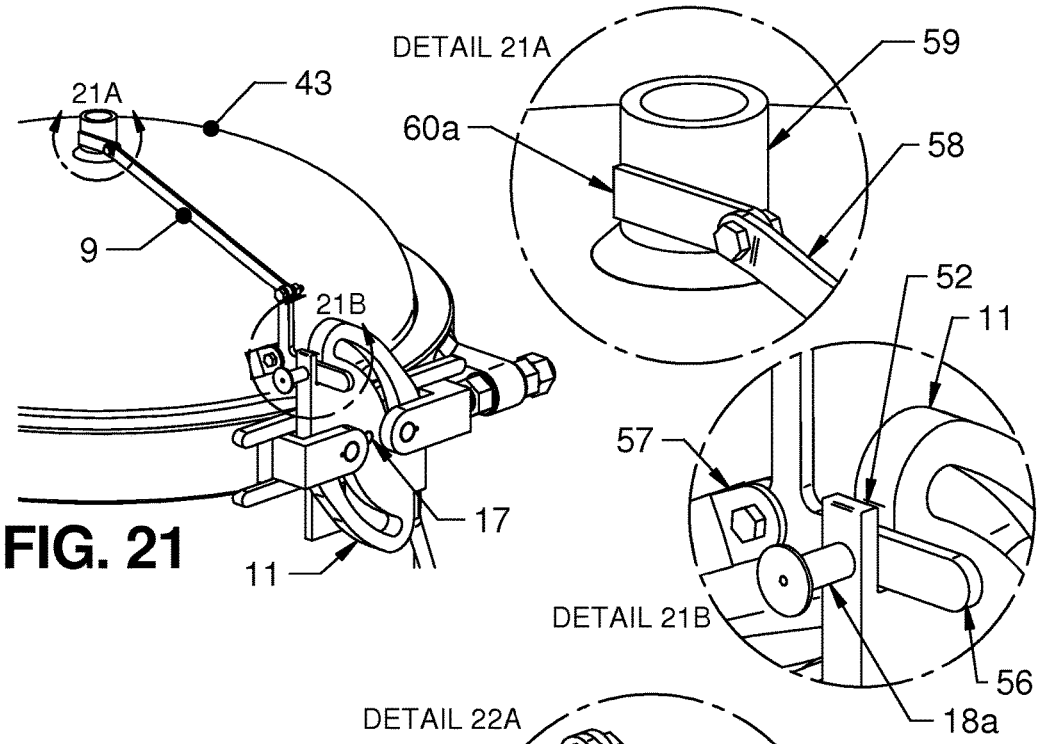
FIG. 21 is a perspective view of the primary safety lock system with details showing the vessel pressure release valve in closed position and the safety lock lever engaged with the closure system cam plate.
Figure 22:
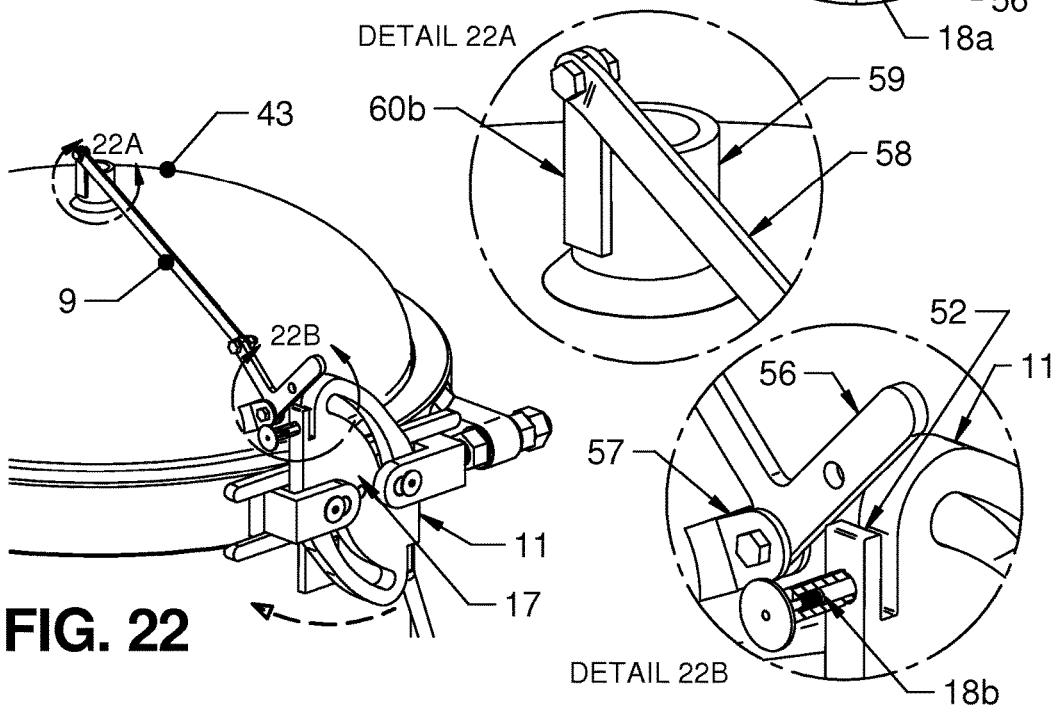
FIG. 22 is a perspective view of the primary safety lock system with details showing the vessel pressure release valve in open position and the safety lock lever disengaged with the closure system cam plate.

With reference to FIG. 21 and FIG. 22, a primary safety lock mechanism 9 is provided to ensure that the quick closure mechanism 20 cannot be actuated to open a pressurized vessel without first releasing the pressure. Detail 21*a* depicts a commercial safety valve 59 used to vent pressure from a vessel. The safety valve lever closed 60*a* is shown in a horizontal orientation, connected to a primary safety lock linkage arm 58. Detail 21*b* illustrates the primary safety lock lever 56 at rest in the cam plate safety lock lever groove 52, restrained by a safety lock release pin 18*a* in the closed position. The said lever embodies a pivot axis coincident with the axis of a bolt mounted through the holes of the primary safety lock mounting bracket 57. While the primary safety lock lever 56 is in the closed position, the tensioning cam plate 11 is restrained from rotating. Detail 22*b* shows the primary safety lock lever 56 disengaged from the cam plate safety lock lever groove 52 only after safety lock release pin 18*b* has been retracted. This action induces the primary safety lock linkage arm to transfer lateral motion to the safety valve lever open 60*b*, causing the safety valve 59 to release vessel pressure. This procedure must be completed before the quick closure mechanism 20 can be actuated through rotation of the tensioning cam plates 11.

Although preferred embodiments of the present invention have been described herein in detail, it will be understood by those skilled in the art that variations may be made thereto without departing from the spirit of the invention or the scope of the appended claims.

What is claimed is:

1. A pressure vessel comprising:

a. a lid assembly;

b. a shell assembly having an opening;

c. a first clamping ring disposed on the underside of the lid assembly;

d. a second clamping ring disposed around the opening of the shell assembly, e. a clamping channel for receiving the first and second clamping rings, the clamping channel comprised of a first channel subassembly and a second channel subassembly, and f. a first closure mechanism operatively connected to a first end of the first channel subassembly and a second end of the second channel assembly, and a second closure mechanism operatively connected to a first end of the second channel subassembly and a second end of the first channel assembly, each closure mechanism comprising a cam plate rotatable about a cam pivot pin affixed between the ends of the first and second channel subassemblies, wherein rotation of the first and second closure mechanisms exerts a radial tension to draw the first and second channel subassemblies in a horizontal plane toward the center of the pressure vessel and brings the first clamping ring into firm contact with the second clamping ring.

2. The pressure vessel of claim 1, further comprising a cam pin affixed to each end of the first and second closure mechanisms.

3. The pressure vessel of claim 2, wherein each cam plate further comprises two cam plate pin guides disposed at opposite sides thereof, each cam plate pin guide for receiving its associated cam pin, wherein the cam plates can be rotated by application of a tensile force, to cause the cam pins to converge radially inward via movement of each cam pin within its associated cam plate pin guide, and in turn to draw the first clamping ring and the second clamping ring of the shell assembly radially toward the center of the pressure vessel.

4. The pressure vessel of claim 3, wherein the cam plate pin guides are arranged symmetrically on each cam plate such that both clamping channels approach toward the center of the pressure vessel at matching rates of displacement upon application of force on the guides.

5. The pressure vessel of claim 3, the cam plate pin guides are curved slots.

6. The pressure vessel of claim 3, the cam plate pin guides have a convex curvature.

7. The pressure vessel of claim 1, further comprising an o-ring disposed on a surface of the first clamping ring, the o-ring for creating a pressure seal when compressed between the first clamping ring and the second clamping ring.

8. The pressure vessel of claim 1, further comprising a lever rod operatively connected to the first and second closure mechanisms, the lever rod for effecting rotation of each closure mechanism upon application of force upon the rod.

9. The pressure vessel of claim 1, wherein the first and second closure mechanisms share a common pivot axis which intersects the vertical central axis of the pressure vessel.

10. The pressure vessel of claim 1, further comprising a cam pin clevis guide plate affixed to an outer surface of the clamping channel at the location of each cam plate, the guide plate for providing alignment of the first channel subassembly and the second channel subassembly in a horizontal plane during contraction or expansion of the clamping channel.

11. A pressure vessel comprising:

a. a lid assembly;

b. a shell assembly having an opening;

c. a first clamping ring disposed on the underside of the lid assembly;

d. a second clamping ring disposed around the opening of the shell assembly, the second clamping ring comprising a first end and a second end, and a plurality of blocks, each of the plurality of blocks having an internal face conforming to the shape of an internal face of the first clamping ring; and e. an at least one closure mechanism operatively connected to the first and second ends of the second clamping ring, the at least one closure mechanism comprising an at least one cam plate rotatable about a cam pivot pin affixed to an outer surface of the shell assembly, wherein the at least one cam plate can be rotated about the cam pivot pin by application of a clockwise or counterclockwise force against the cam plate, to move the second clamping ring into a locked position around the first clamping ring wherein the first and second ends of the second clamping ring are forced toward one another and into a tension fit with the first clamping ring, or an unlocked position wherein the first and second ends of the second clamping ring are spaced apart and the lid assembly can be lifted into an open position.

12. A pressure vessel comprising:

a. a lid assembly;

b. a shell assembly having an opening;

c. a first clamping ring disposed on the underside of the lid assembly;

d. a second clamping ring disposed around the opening of the shell assembly, the second clamping ring comprising a first side wall terminating in a first end and a second end and a second side wall terminating in a first end and a second end, wherein the first clamping ring is shaped for insertion into a channel formed on the second clamping ring; and e. two closure mechanisms positioned on opposite sides of the shell assembly, being a first closure mechanism operatively connected to the first and second ends of the first side wall and a second closure mechanism operatively connected to the first and second ends of the second side walls, each closure mechanism comprising a rotatable cam plate, the cam plate having two cam plate pin guides disposed at opposite sides thereof, the cam plate pin guides of convex curvature and symmetric arrangement on each cam plate, and an at least one cam pin associated with each cam plate pin guide, each of the at least one cam pins affixed to an outer surface of the ends of the first and second side walls.

wherein the cam plates can be rotated by application of a tensile force, to cause the associated cam pins to converge radially inward via movement of each pin within its associated cam plate pin guide, and in turn to draw the first clamping ring and the second clamping ring of the shell assembly radially toward the center of the pressure vessel.

* * * * *